US007701125B2

(12) United States Patent
Wei et al.

(10) Patent No.: US 7,701,125 B2
(45) Date of Patent: Apr. 20, 2010

(54) FIELD EMISSION LAMP

(75) Inventors: Yang Wei, Beijing (CN); Lin Xiao, Beijing (CN); Feng Zhu, Beijing (CN); Liang Liu, Beijing (CN); Shou-Shan Fan, Beijing (CN)

(73) Assignees: Tsinghua University, Beijing (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 211 days.

(21) Appl. No.: 11/951,157

(22) Filed: Dec. 5, 2007

(65) Prior Publication Data

US 2008/0143240 A1 Jun. 19, 2008

(30) Foreign Application Priority Data

Dec. 13, 2006 (CN) ..... 2006 1 0157608

(51) Int. Cl.
*H01J 1/62* (2006.01)

(52) U.S. Cl. ..... 313/493; 313/495

(58) Field of Classification Search ..... 313/491, 313/493, 495, 309, 310, 336, 351
See application file for complete search history.

(56) References Cited

U.S. PATENT DOCUMENTS 4,818,914 A * 4/1989 Brodie ..... 315/169.3
2006/0017370 A1 1/2006 Wei et al.

FOREIGN PATENT DOCUMENTS

| | | | |
|---|---|---|---|
| CN | 1619762 | | 5/2005 |
| CN | 1725428 | A | 1/2006 |
| JP | 2007173161 | A * | 7/2007 |

* cited by examiner

*Primary Examiner*—Vip Patel
(74) *Attorney, Agent, or Firm*—D. Austin Bonderer

(57) ABSTRACT

A field emission lamp (2) includes a housing (20), a first electrode (22), and a second electrode (24). The housing (20) includes a first supporting element (201) and a second supporting element (202). The first supporting element (201) is disposed at one end of the housing (20). The second supporting element (202) is disposed at opposite end of the housing (20). The first electrode (22) includes an electron emitter (222) and a first electric conduction element (224) electrically connected with the electron emitter (222). The first electric conduction element (224) is fastened to the first supporting element (201). The second electrode (24) includes an electric conduction membrane (241), a fluorescent layer (242) and a second electric conduction element (243). The fluorescent layer (242) is disposed on the electric conduction membrane (241) and corresponding to the electron emitter (222). The second electric conduction element (243) is electrically connected with the electric conduction membrane (241) and is fastened to the second supporting element (202).

18 Claims, 2 Drawing Sheets

FIELD EMISSION LAMP

BACKGROUND OF THE INVENTION

1. Field of the Invention

The invention relates to lamps and, particularly, to a field emission lamp.

2. Description of Related Art

A display device, such as a LCD, often requires a backlight device installed on the backside to provide illumination. Typically, a cold cathode fluorescent lamp (CCFL) has been commonly used as a light source of the backlight device. The CCFL includes a sealed tube and a pair of electrodes respectively disposed at two ends of the sealed tube. A fluorescent layer coated on an inner surface of the sealed tube. The sealed tube is filled with a mixture including an inert gas and mercury vapor. When a voltage is applied to the electrodes, electrons are emitted from the negative electrode. The electrons strike and excite the atom of the mercury vapor and thereby ultraviolet radiation is generated. The ultraviolet radiation in turn strikes the fluorescent layer resulting in visible radiation. However, the mercury vapor, the prominent component of CCFL, is harmful to people and causes environmental pollution.

Field emission lamp without mercury as an alternative light source for backlight devices is also available. This type of field emission lamp includes a cathode and an anode disposed opposite to each other. An electron emitting layer is disposed on the cathode. A fluorescent layer is disposed on the anode. When a predetermined voltage is applied between the cathode and the anode, electrons emitted from the electron emitting layer collide against the fluorescent layer, thereby generating visible light.

However, the electrodes of such mercury free field emission lamp is difficult to manufacture because the cathode and the anode are at the same end of the field emission lamp.

What is needed, therefore, is a field emission lamp with simple structure so as to be much easier on manufacturing.

SUMMARY OF THE INVENTION

A field emission lamp is provided. In one embodiment, the field emission lamp includes a housing, a first electrode, and a second electrode. The housing includes a first supporting element and a second supporting element. The first supporting element is disposed at one end of the housing. The second supporting element is disposed at an opposite end of the housing. The first electrode includes an electron emitter and a first electric conduction element. The first electric conduction element is electrically connected with the electron emitter and fastened to the first supporting element. The second electrode includes an electric conduction membrane, a fluorescent layer and a second electric conduction element. The fluorescent layer is disposed on the electric conduction membrane and corresponding to the electron emitter. The second electric conduction element is electrically connected with the electric conduction membrane and is fastened to the second supporting element.

Other advantages and novel features of the present field emission lamp will become more apparent from the following detailed description of preferred embodiments when taken in conjunction with the accompanying drawings.

BRIEF DESCRIPTION OF THE DRAWINGS

Many aspects of the present field emission lamp can be better understood with reference to the following drawings.

The components in the drawings are not necessarily to scale, the emphasis instead being placed upon clearly illustrating the principles of the present field emission lamp.

Figure 1:
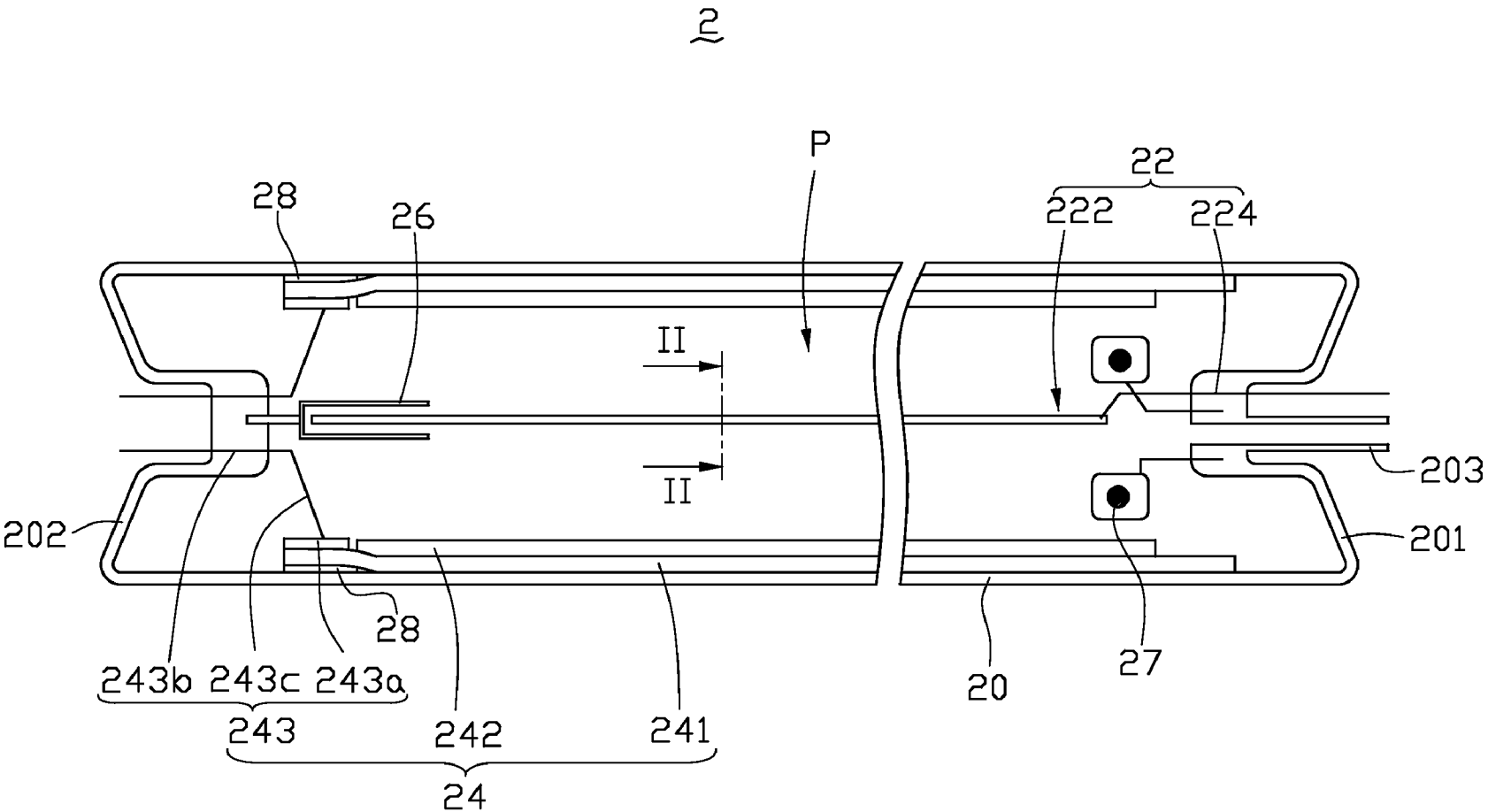
FIG. 1 is a sectional view of a field emission lamp, in accordance with a present embodiment.

Corresponding reference characters indicate corresponding parts throughout the several views. The exemplifications set out herein illustrate at least one preferred embodiment of the present field emission lamp, in one form, and such exemplifications are not to be construed as limiting the scope of the invention in any manner.

DETAILED DESCRIPTION OF THE INVENTION

Reference will now be made to the drawings to describe embodiments of the present field emission lamp, in detail.

Referring to FIG. 1, a field emission lamp, according to a present embodiment, is shown. The field emission lamp 2 includes a housing 20, a first electrode 22, and a second electrode 24. In the present embodiment, the field emission lamp 2 is configured for acting as a light source to provide illumination.

In the present embodiment, the housing 20 is in tube-shape. The housing 20 includes a first supporting element 201 and a second supporting element 202. The first supporting element 201 is disposed at one end of the housing 20 while the second supporting element 202 is disposed at an opposite end of the housing 20. That is, the first supporting element 201 and the second supporting element 202 are used to seal the housing 20 so as to form an enclosed space P inside the housing 20. In the present embodiment, the supporting elements 201, 202 and the housing 20 can be separated elements to assemble with each other. Alternatively, the supporting elements 201, 202 and the housing 20 can be integrated into a single element.

Additionally, the housing 20 further includes an exhaust pipe 203 disposed on the first supporting element 201 (as shown in FIG. 1) or the second supporting element 202. One end of the exhaust pipe 203 can be connected with a vacuum pump (not shown in FIG. 1). An opposite end of the exhaust pipe 203 connects with the enclosed space P. That is, gases in the housing 20 can be guided through/via the exhaust pipe 203 away from the outside of the housing 20 by the vacuum pump. Furthermore, the end of the exhaust pipe 203 can be sealed so as to keep the housing 20 in a vacuum state.

Figure 2:
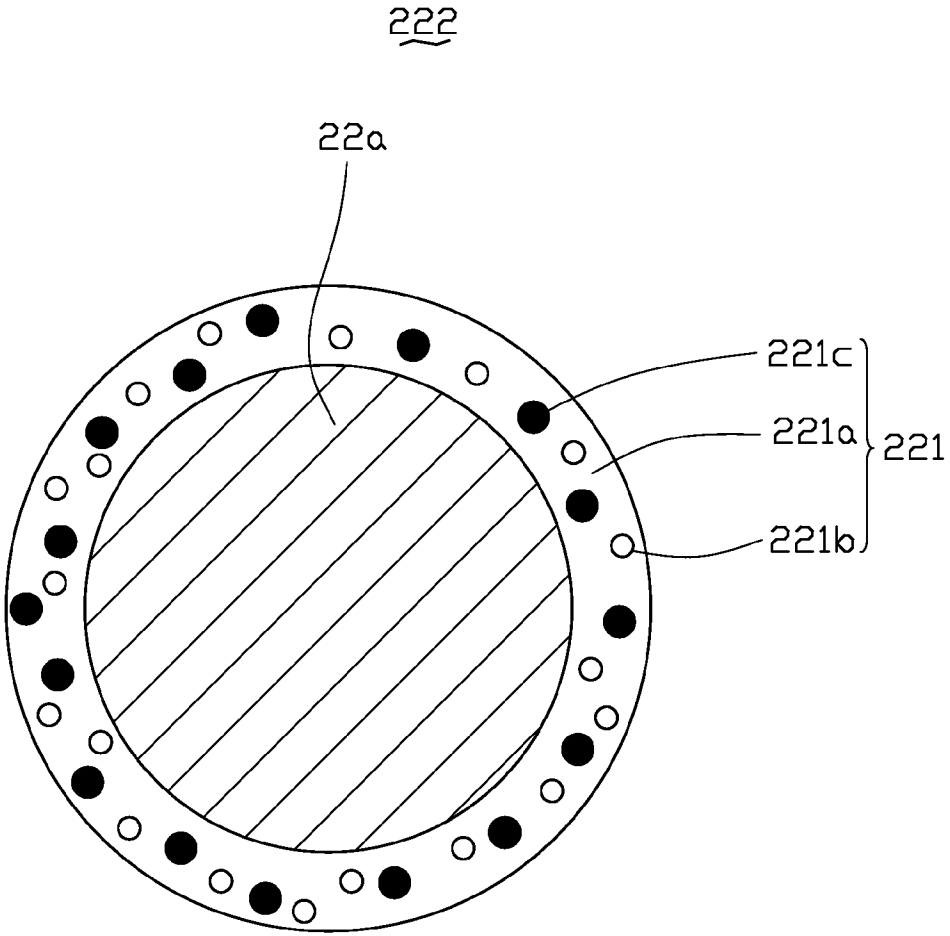
FIG. 2 is an enlarged sectional view of a first electrode of the field emission lamp of FIG. 1 along a line II-II.

Referring to FIG. 1 and FIG. 2, the first electrode 22 is centrally and longitudinally accommodated in the housing 20. One end of the first electrode 22 is fastened to the second supporting element 202 through/via a nickel tube 26 and is parallel to an axial direction of the housing 20. The first electrode 22 includes an electron emitter 222 and a first electric conduction element 224. The first electric conduction element 224 is electrically connected with the electron emitter 222. In particular, the first electric conduction element 224 is connected with an end of the electric emitter 222 opposite to the end of the electric emitter 222 connected to the nickel tube 26. The first electric conduction element 224 is fastened to the first supporting element 201. Additionally, one portion of the first electric conduction element 224 is extended to the outside of the housing 20 so as to connect to an external power supply (not shown in FIG. 1).

Referring to FIG. 2, in the present embodiment, the electron emitter 222 includes an electric conduction unit **22*a* and an electron emitting layer 221. The electron emitting layer 221 is disposed on the electric conduction unit 22*a*. The electric conduction unit 22*a* is in a cylindrical shape (as shown in FIG. 2) or in a filamentary shape. In addition, the electric conduction unit 22***a* has a diameter in an approximate range from 0.1 mm to 2 mm. The electric conduction unit 22*a* is made of a metal or an alloy thereof. Suitably, the electric conduction unit 22*a* is made of nickel (Ni).

Referring to FIG. 2, the electron emitting layer 221 is comprised of glass 221*a*, a plurality of carbon nanotubes 221*b*, and a plurality of electric conduction particles 221*c*. The plurality of carbon nanotubes 221*b* and the plurality of electric conduction particles 221*c* are dispersed in the glass 221*a*. In such case, the plurality of carbon nanotubes 221*b* is configured to emit electrons. However, material for use to emit electrons is not limited to the carbon nanotubes 221*b*, other field emission material having a low work function, such as tungsten, also can be applied. In the present embodiment, each of the carbon nanotubes 221*b* has a length in an approximate range from 1 μm to 100 μm and a diameter in an approximate range from 1 nm to 100 nm.

Furthermore, an elastic element, such as a spring, can be disposed between the electron emitter 222 and the first electric conduction element 224. In such manner, as the external power supply is on, the elastic element is configured for the electron emitter 222 to against expansion when hot. As the external power supply is off, the elastic element 224 is also configured for the electron emitter 222 to against shrink when cold.

Referring to FIG. 1, the second electrode 24 is spaced apart from the first electrode 22. The second electrode 24 includes an electric conduction membrane 241, a fluorescent layer 242 and a second electric conduction element 243. The electric conduction membrane 241 is disposed on an inner surface of the housing 20. In the present embodiment, the electric conduction membrane 241 is a transparent electric conduction membrane. Particularly, the electric conduction membrane 241 is made of indium tin oxide (ITO). Moreover, the electric conduction membrane 241 can include a plurality of carbon nanotubes. In such manner, the electric conduction membrane 241 is formed using the slurry containing carbon nanotubes. In the present embodiment, each of the carbon nanotubes has a length in an approximate range from 1 μm to 100 μm. Suitably, each of the carbon nanotubes is about 10 μm in length. In addition, each of the carbon nanotubes has a diameter in an approximate range from 1 nm to 100 nm.

As mentioned above, the fluorescent layer 242 is disposed on the electric conduction membrane 241 corresponding to the electron emitter 222. Therefore, when electrons are emitted from the carbon emitter 222 and are accelerated to impinge on the fluorescent layer 242, the light is emitted from the fluorescent layer 242. In the present embodiment, the fluorescent layer 242 is made of material with high efficiency, low applied voltage, and high luminance. Additionally, the fluorescent layer 242 can be made of a white fluorescent material or a color fluorescent material. The fluorescent layer 242 exposes a portion of the electric conduction membrane 241 used for facilitating the second electric conduction element 243 to electrically connect with. The second electric conduction element 243 includes a lead pad 243*a*, a lead rod 243*b* and a lead wire 243*c*. The lead pad 243*a* is disposed on the electric conduction membrane 241. In particular, the lead pad 243*a* is disposed on the exposed portion of the electric conduction membrane 241 so as to electrically connect with the electric conduction membrane 241. The lead rod 243*b* is fastened to the second supporting element 202 and is parallel to an axial direction of the housing 20. The lead wire 243*c* electrically interconnects the lead pad 243*a* with the lead rod 243*b*. One portion of the lead rod 243*b* is extended to the outside of the housing 20 for electrically connecting with the external power supply. Therefore, the second electrode 24 is applied the predetermined voltage from the external power supply. Additionally, in the present embodiment, the lead pad 243*a* can be a spring.

The second electrode 24 further includes colloidal graphite 28 disposed between the inner surface of the housing 20 and the electric conduction membrane 241. In particular, the colloidal graphite 28 is disposed corresponding to the exposed portion of the electric conduction membrane 241. The colloidal graphite 28 is used to guarantee good conductivity between the electric conduction membrane 241 and the second electric conduction element 243.

However, the second electric conduction element 243 is not limited to what is mentioned above. Alternatively, the second electric conduction element 243 can be a single electric conduction rod or a single electric conduction filament to interconnect the electric conduction membrane 241 with the external power supply. In addition, the second electric conduction element 243 also can be composed of a lead pad and an electric conduction rod/filament. In such case, the lead pad is electrically connected to the electric conduction membrane 241. The electric conduction rod/filament interconnects the lead pad with the external power supply so as to provide the suitable voltage to the electric conduction membrane 241.

Additionally, the field emission lamp 2 further includes at least one getter 27 accommodated in the housing 20. In the present embodiment, two getters 27 are fastened to the first supporting element 201 of the housing 20. The getters 27 are configured to absorb the residual gases to further guarantee that the housing 20 is kept in a vacuum state.

In conclusion, by way of fastening the first electric conduction element 224 of the first electrode 22 and the second electric conduction element 243 of the second electrode 24 to the first supporting element 201 and the second supporting element 202 respectively, it is favorable for the manufacturing of the field emission lamp 2. That is, comparing to the conventional structure of the field emission lamp, assembling the first electric conduction element 224 and the second electric conduction element 243 at different ends of the housing 20 provides simpler structure to be easier on manufacturing. In addition, when the predetermined voltage is applied to the first electrode 22 and the second electrode 24 through the first electric conduction element 224 and the second electric conduction element 243, an electric field is formed between the first electrode 22 and the second electrode 24. Electrons are emitted from the electron emitter 222 of the first electrode 22 and are accelerated to impinge on the fluorescent layer 242 of the second electrode 24 under the electric field. As a result, colored light is emitted from the fluorescent layer 242 made of the color fluorescent material while white light is emitted from the fluorescent layer 242 made of the white fluorescent material.

Finally, it is to be understood that the above-described embodiments are intended to illustrate rather than limit the invention. Variations may be made to the embodiments without departing from the spirit of the invention as claimed. The above-described embodiments illustrate the scope of the invention but do not restrict the scope of the invention.

What is claimed is:

1. A field emission lamp, comprising:

a housing comprising a first supporting element and a second supporting element, the first supporting element being located at one end of the housing, the second supporting element being located at opposite end of the housing;

a first electrode comprising an electron emitter and a first electric conduction element electrically connected with the electron emitter, the first electric conduction element being secured to the first supporting element; and a second electrode comprising an electric conduction membrane, a fluorescent layer, and a second electric conduction element; the fluorescent layer being located on the electric conduction membrane and corresponding to the electron emitter; and the second electric conduction element being electrically connected with the electric conduction membrane and being secured to the second supporting element.

2. The field emission lamp as claimed in claim 1, wherein one end of the first electric conduction element is electrically connected to the electron emitter and an opposite end of the first electric conduction element is extended to the outside of the housing.

3. The field emission lamp as claimed in claim 1, wherein the electron emitter is fastened to the second supporting element through a nickel tube.

4. The field emission lamp as claimed in claim 1, wherein the electron emitter is parallel to an axial direction of the housing.

5. The field emission lamp as claimed in claim 1, wherein the electron emitter is in a cylindrical shape or in a filamentary shape.

6. The field emission lamp as claimed in claim 1, wherein the electron emitter comprises an electron emitting layer including a plurality of carbon nanotubes.

7. The field emission lamp as claimed in claim 1, wherein the electric conduction membrane is a transparent electric conduction membrane.

8. The field emission lamp as claimed in claim 7, wherein the transparent electric conduction membrane comprises a plurality of carbon nanotubes.

9. The field emission lamp as claimed in claim 1, wherein the second electric conduction element comprises a lead pad, a lead rod and a lead wire, the lead pad is located on the electric conduction membrane, the lead rod is fastened to the second supporting element, the lead wire electrically interconnects the lead pad with the lead rod.

10. The field emission lamp as claimed in claim 9, wherein the lead pad is a spring.

11. The field emission lamp as claimed in claim 9, wherein the lead rod is extended to the outside of the housing.

12. The field emission lamp as claimed in claim 9, wherein the second electrode further comprises colloidal graphite located between the electric conduction membrane and an inner surface of the housing, the colloidal graphite is located corresponding to the lead pad.

13. The field emission lamp as claimed in claim 1, wherein the housing further comprises an exhaust pipe located on the first supporting element or the second supporting element.

14. The field emission lamp as claimed in claim 1, further comprising:

at least one getter accommodated in the housing.

15. The field emission lamp as claimed in claim 6, wherein the electron emitting layer is further comprised of glass and a plurality of electric conduction particles.

16. The field emission lamp as claimed in claim 15, wherein the plurality of carbon nanotubes and the plurality of electric conduction particles are dispersed in the glass.

17. The field emission lamp as claimed in claim 6, wherein the electron emitter further comprises an electric conduction unit, the electron emitting layer being located on the electric conduction unit.

18. The field emission lamp as claimed in claim 1, wherein the electric conduction membrane is located on an inner surface of the housing.

* * * * *